United States Patent [19]

Poyer

[11] Patent Number: 4,667,278

[45] Date of Patent: May 19, 1987

[54] OUTDOOR LIGHTING FIXTURE

[76] Inventor: David D. Poyer, 858 Roseway St., Naples, Fla. 33942

[21] Appl. No.: 837,893

[22] Filed: Mar. 10, 1986

[51] Int. Cl.[4] ..... F21V 29/00

[52] U.S. Cl. ..... 362/267; 362/311; 362/375

[58] Field of Search ..... 362/267, 431, 375, 311, 362/362, 202; 340/93; D26/104, 105

[56] References Cited

U.S. PATENT DOCUMENTS

| | | | |
|---|---|---|---|
| 1,435,002 | 11/1922 | Goodwin et al. | 362/311 |
| 2,970,209 | 1/1961 | Glowzinski et al. | 362/267 |
| 3,337,725 | 8/1967 | Nash | 362/267 |
| 3,902,057 | 8/1975 | La Violette | 340/93 |
| 4,344,118 | 8/1982 | Rundquist et al. | 362/267 |
| 4,523,263 | 6/1985 | Poyer | 362/267 |

*Primary Examiner*—Charles J. Myhre
*Assistant Examiner*—D. M. Cox
*Attorney, Agent, or Firm*—Merrill N. Johnson

[57] ABSTRACT

An electric lighting fixture for outdoor use having a generally cylindrical housing of polyvinyl chloride with concentric outer and inner walls and an annular flange projecting from the center of said inner wall, a first cylindrical spacer ring whose lower end rests on the annular flange within the housing, a circular lens sealed to the upper end of the first spacer ring, a low voltage lamp within said housing having a circular outer edge with a diameter slightly less than the inner diameter of the housing, a second spacer ring having an outer diameter slightly less than the inner diameter of the housing, a cup-shaped base plate having an axial hole in its bottom, and an electric power line passing through the end connected to the low voltage lamp, the outer edge of the lamp lying between the annular flange of the housing and the second spacer ring and the upper edge of the base plate resting against the lower edge of the second spacer ring.

1 Claim, 5 Drawing Figures

FIG. 4
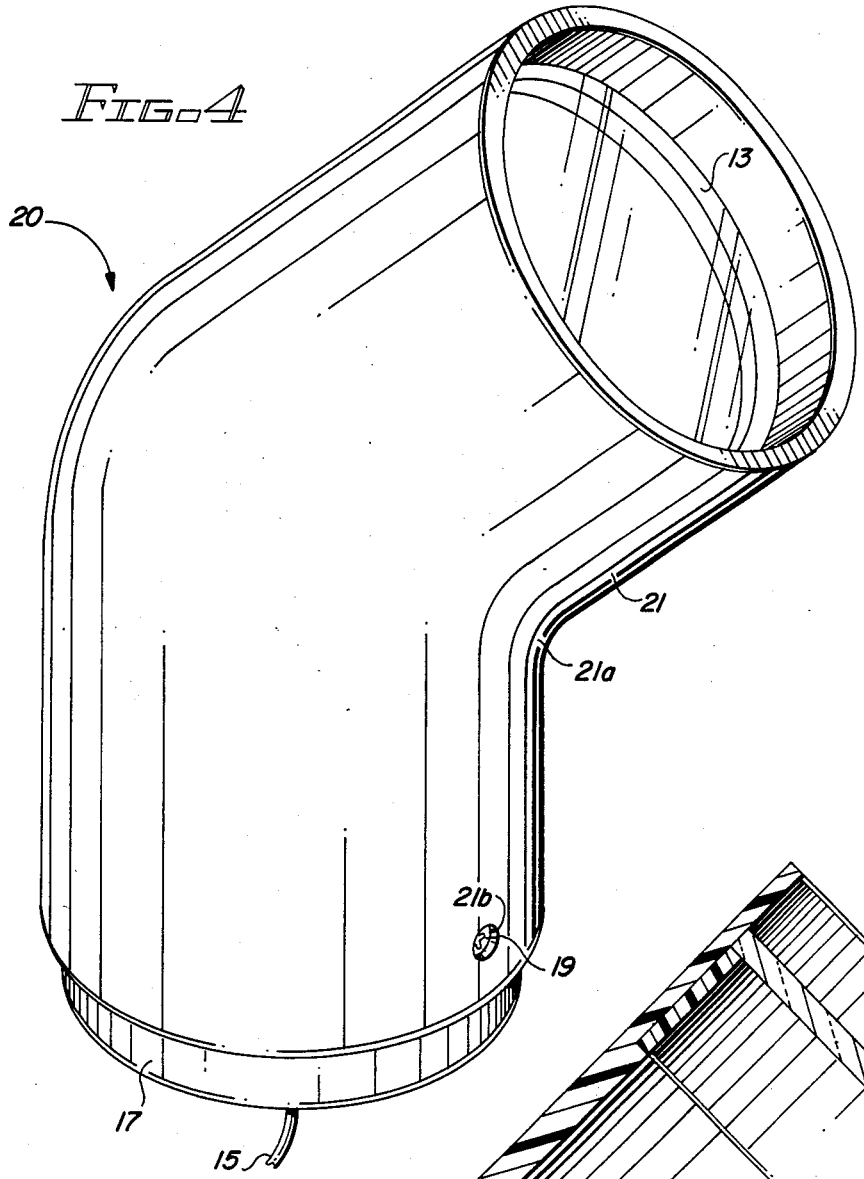
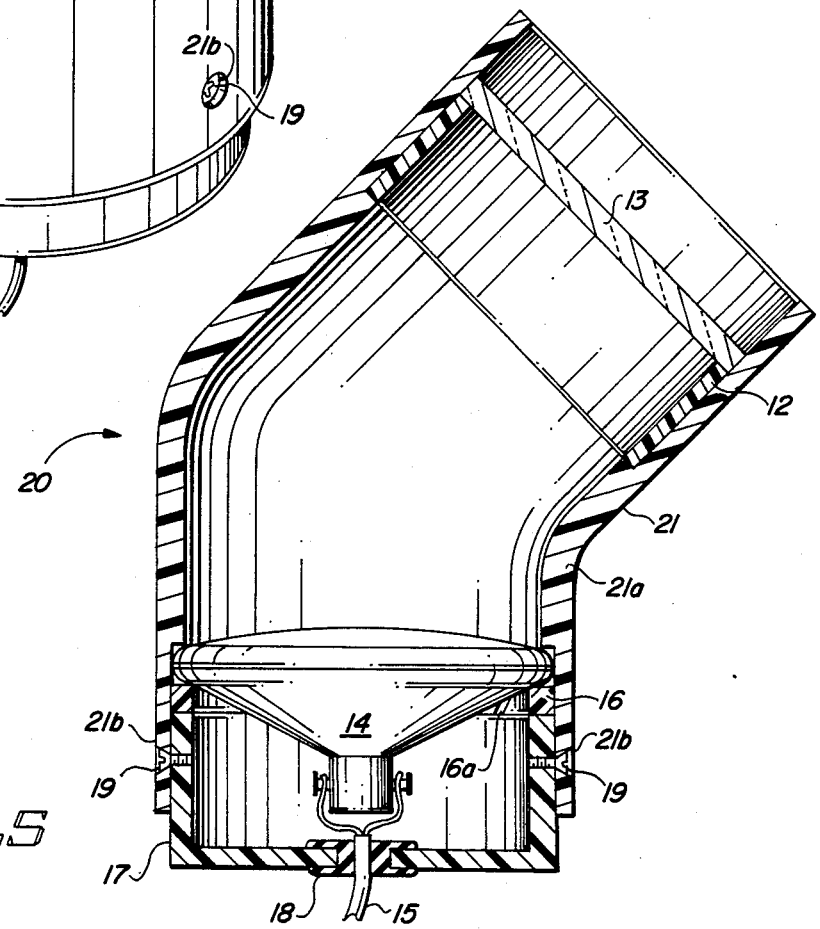
FIG. 5

OUTDOOR LIGHTING FIXTURE

BACKGROUND AND SUMMARY OF THE INVENTION

My invention relates to a simplified electric lighting fixture and in particular to a low voltage lighting fixture designed for outdoor use constructed mainly of polyvinyl chloride resin.

Until recently, for various reasons, most electric lighting fixture housings and fittings have been made of metal. One reason is that metals do not deteriorate or deform as the result of the high temperatures generated within a lighting fixture by the standard 110 volt lamps used in conventional lighting fixtures. However, for lighting fixtures designed for use out-of-doors, most metal housings and fittings are subject to rapid corrosion due to constant exposure to rain and sun and in coastal areas, to salt spray, even when the metal parts are temporarily protected by paint. Moreover, increases in the price of steel and aluminum and in fabricating costs have resulted in increases in the prices of conventional lighting fixtures with housings and fittings made of metal.

The present trend to reduce energy consumption has resulted in increased use of low voltage lamps, that is, electric lamps which operate at voltages considerably less than 110 volts. These low voltage lamps, particularly 12 volt lamps, generate far less heat in operation than 110 volt lamps.

My prior U.S. Pat. No. 4,523,263 discloses a satisfactory outdoor lighting fixture for use with a low voltage lamp which has a housing and essentially all its components made of polyvinyl chloride resin.

I have now invented a simplified and improved outdoor lighting fixture using a low voltage lamp and a minimum of parts made principally of polyvinyl chloride resin. My unique lighting fixture comprises only seven major components: a generally cylindrically shaped housing having an interior annular ring preferably made entirely of high density polyvinyl chloride resin (hereinafter often referred to as PVC); a low voltage electric lamp having an outer diameter slightly less than the inside diameter of the cylindrical housing; a lens having an outer diameter slightly less than the inside diameter of the housing; first and second spacer rings each made of PVC and having an outside diameter slightly less than the interior diameter of the housing; a circular base plate made of PVC for closing the rear of the housing; and an electric line connected to said low voltage lamp and running through a hole in said circular base plate to energize the lamp.

As assembled, the circular lens is sealed to the upper end of the first spacer ring and with the lower end of the first spacer ring resting on the annular ring within the housing, the spacer is sealed into the housing. The low voltage lamp with its terminals connected to the electric line running through the hole in the circular base and the base are then inserted into the rear of the housing. The second spacer ring, which preferably is split for ease of assembly, rests against the outer edge of the lamp. The base is then inserted into the housing and with the upper edge of the base securing the second spacer ring against the lamp, the base is secured to the rear end of the housing.

Various modifications or additions can be made to the basic fixture just described. The front part of this housing may be straight or angled in relation to the rear of the housing. A mounting bracket or swiveled stand can be added to the rear of the housing.

I am aware of a number of prior suggestions in the art to use various plastic and elastomeric resins in the fabrication of lighting fixture components. These suggestions include U.S. Pat. Nos. 3,902,057; 4,210,841; 4,360,862; 4,379,321; 4,380,793 and 4,414,613 and my own prior U.S. Pat. Nos. 4,523,263 and 4,564,890. However, my outdoor lighting fixture possesses the following advantages over conventional outdoor fixtures as well as over the devices shown in the foregoing patents:

1. Because its components are already available in quantity, the cost of its components is lower than the cost of conventional fixture components.

2. Because its components can be quickly assembled by unskilled labor, my lighting fixture costs less to manufacture than conventional fixtures.

3. Because it utilizes a low voltage lamp and its housing is constructed of high density polyvinyl chloride resin, the housing will not deteriorate or deform in operation and the fixture is literally impervious to the deleterious effects of sun, rain and salt spray even in tropical climates.

BRIEF DESCRIPTION OF THE DRAWINGS

My invention will be fully understood from the following description of two preferred embodiments and the appended drawings in which:

FIG. 4 is a perspective view of a second preferred embodiment of my simplified outdoor lighting fixture.

FIG. 5 is a cross-sectional view of the fixture shown in FIG. 4.

DETAILED DESCRIPTION OF THE PREFERRED EMBODIMENTS

Figure 1:
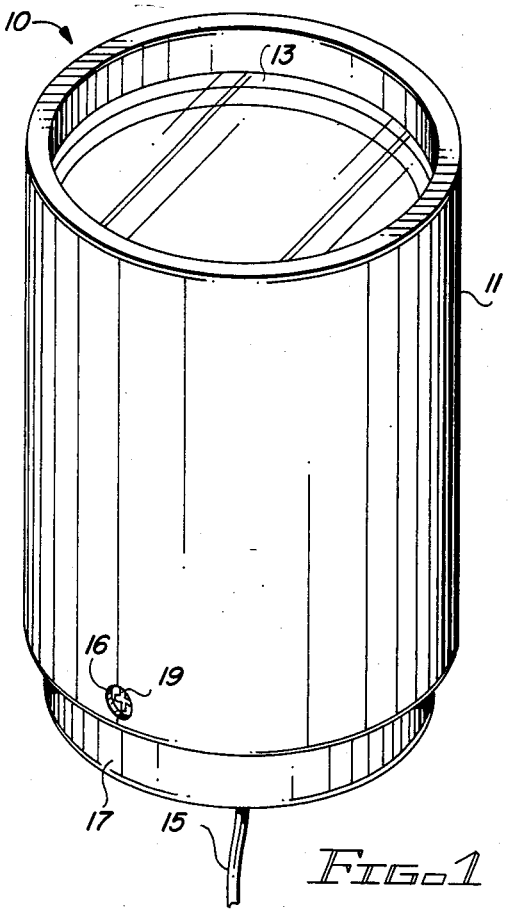
FIG. 1 is a perspective view of one preferred embodiment of my simplified outdoor lighting fixture.
Figure 2:
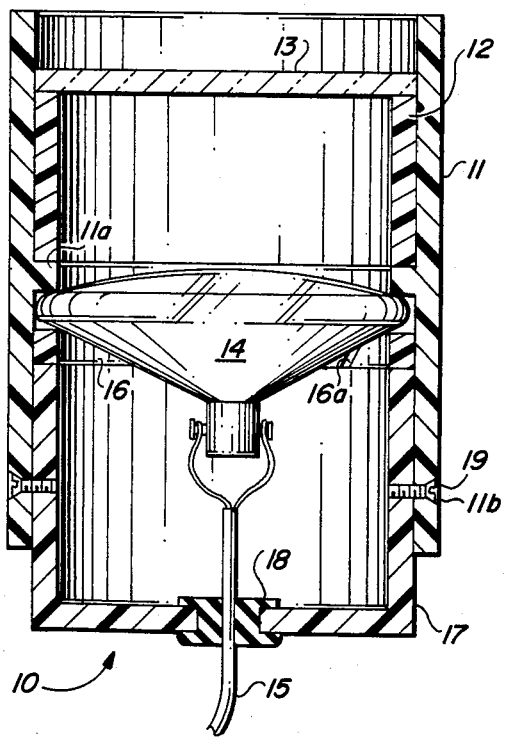
FIG. 2 is a cross-sectional view of my lighting fixture shown in FIG. 1.

Referring to the drawings which show two different preferred embodiments of my simplified outdoor lighting fixture, FIG. 1 is a perspective view of the cylindrical form of the lighting fixture 10 with its cylindrical housing 11 in a generally upright or vertical position. FIG. 2 is a cross-sectional view and FIG. 3 an exploded view of lighting fixture 10 showing the fixture's major components and their manner of assembly.

Figure 3:
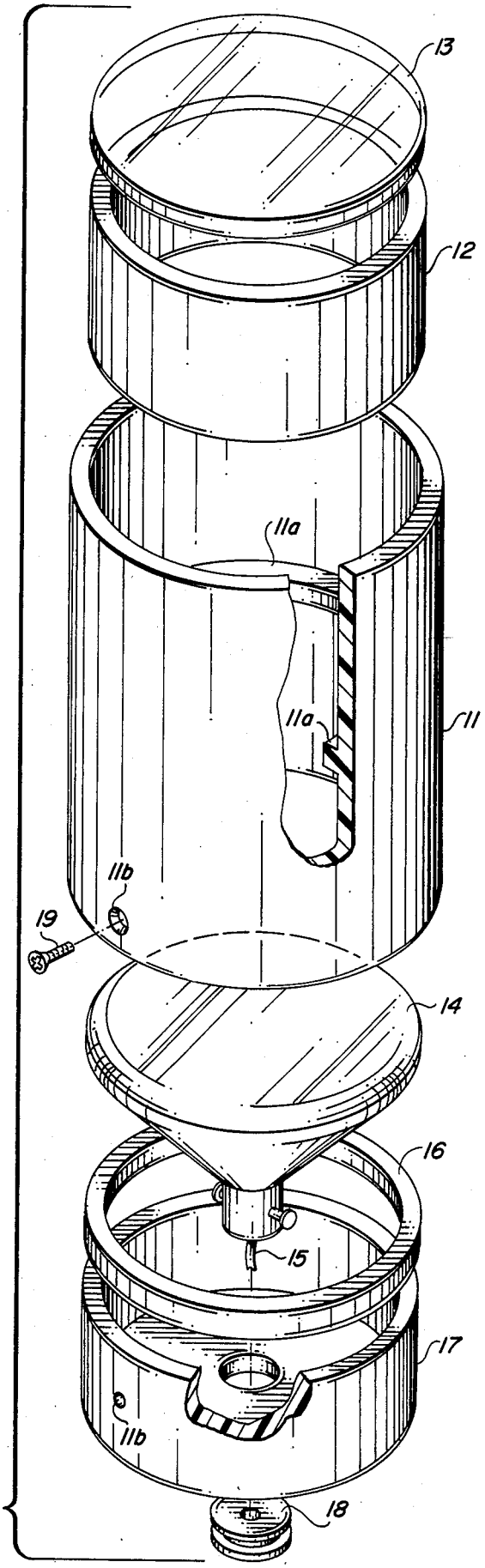
FIG. 3 is an exploded perspective view of the fixture shown in FIGS. 1 and 2 which illustrates details of various components of the fixture and the manner of their assembly.

Housing 11 is a standard 5-inch outside diameter coupling conventionally used for joining electrical plastic conduit (EPC) having an annular ring 11*a* molded into the interior wall of housing 11 as shown in FIGS. 2 and 3. Ring 11*a* as shown is square in cross-section. Housing 11 is made of the same high density polyvinyl chloride resin as the conduit itself. Housing 11 is preferably manufactured to National Electrical Manufacturers Association standards designation EPC-40-PVC or EPC-80-PVC.

Lens 13 as shown is a flat circular disc made of clear or tinted plastic or glass but the lens may be curved rather than flat. The outside diameter of lens 13 is just slightly less than the inside diameter of housing 11. Spacer ring 12 is preferably made of PVC and has an outside diameter slightly less than the inside diameter of housing 11 and a height of 1½ inches.

Lens 13 is sealed to the upper end of spacer ring 12 by epoxy glue or other appropriate water-proof sealing means. Then the combined lens and spacer ring are pushed down into housing 11 until the lower end of spacer ring 12 is resting upon the upper edge of flange 11*a*. A small amount of epoxy glue spread on the upper surface of flange 11*a* and on that portion of the inner wall of housing 11 above flange 11*a* will assure a water-proof seal between the housing and lens and spacer ring.

Electric lamp 14 is preferably a General Electric Company model H 7514 lamp which operates at 18 watts off a 12 volt alternating current power line. Other low voltage lamps operating on either direct or alternating current may, of course, be used. Lamp 14 has an outside diameter of 4⅜ths inches and an overall height of 2½ inches with two screw type terminals in the lamp's base for connection to the two wire ends of low voltage line 15 as shown in FIG. 2.

Spacer ring 16 is made preferably of PVC and has an outside diameter slightly less than the inside diameter of housing 11 and a height of approximately ¾th of an inch. In order to facilitate the assembly of lamp 14 into housing 11, ring 16 is preferably split at 16*a* as shown in FIG. 2.

The lower end of housing 11 is closed by a cup-shaped base plate 17 which has an axially located hole that is filled by a rubber gromet 18 through which passes low voltage line 15 as shown in FIG. 2. Lamp 14 with the wire ends of line 15 attached to its terminals is inserted into the lower end of housing 11 until the upper edge of the lamp rests against the lower surface of flange 11*a*. Spacer ring 16 is then pressed against the lower edge of the lamp and base plate 17 inserted into housing 11 until the upper edge of the base plate rests firmly against ring 16.

The lamp 14, ring 16 and base plate 17 are maintained in place by two or more set screws 19 which are inserted into two or more countersunk holes 11*b* in the lower end of housing 11 and then screwed into the side of base plate 17 as best shown in FIG. 2.

FIGS. 4 and 5 of the drawings illustrate a second preferred embodiment of my simplified outdoor lighting fixture. The components of the second form are essentially the same as with fixture 10 except for the housing. Fixture 20 uses a housing 21 in the shape of a standard 5-inch outside diameter 135 degree angled joint used for joining electrical plastic conduit. Housing 21 has on its interior wall an extended annular flange 21*a* whose upper and lower surfaces provide flat circular surfaces within housing 21 which serve the same function as the upper and lower flat circular surfaces of flange 11*a* of the first embodiment of the simplified lighting fixture.

Fixture 20 is assembled by gluing lens 13 to spacer ring 12 and then inserting these joined components into the upper end of housing 21 until the lower end of ring 12 rests on the upper flat surface of flange 21*a* and then lens 13 and ring 12 are sealed into place within housing 21.

Low voltage line 15 is connected to the terminals of lamp 14 and line 15 is passed through gromet 18 in the bottom of base plate 17. Lamp 14 and spacer ring 16 are then inserted into the lower end of housing 21. With the upper outer edge of lamp 14 resting against the lower flat surface of flange 21*a* and ring 16 resting against the lower outer edge of the lamp, base plate 17 is inserted into housing 21 until the upper edge of the base plate rests against ring 16.

As with fixture 10, the lamp, ring and base plate are maintained in place within housing 21 by a plurality of set screws 19 inserted through countersunk holes 21*b* in housing 21 and then screwed into the side of the base plate.

When assembled as described, fixtures 10 and 20 will provide low cost illumination out of doors without danger that the fixture will deteriorate due to constant exposure to sun, rain, salt air and the heat generated by the lamp itself. Moreover, because of its minimal number of components, all of which are readily available at economical cost due to their high volume production, my simplified lighting fixture can be manufactured more cheaply than other conventional lighting fixtures.

It will be apparent to those skilled in the art that various changes and modifications of the lighting fixture as shown may be made as well as additional components added without departing from the scope and spirit of my invention. And while I have shown and described two preferred embodiments, the scope of my invention is limited and defined only by the following claims.

I claim:

1. An electric lighting fixture for outdoor use comprising a generally cylindrical housing made of polyvinyl chloride having concentric outer and inner walls and an annular flange projecting from the center of said inner wall;

a first cylindrical spacer ring made of polyvinyl chloride having an outer diameter slightly smaller than the inner diameter of the housing and whose lower end rests on the annular flange within the housing;

a circular lens whose diameter equals the outer diameter of the spacer ring sealed to the upper end of the first spacer ring;

a low voltage lamp within said housing having a circular outer edge with a diameter slightly less than the inner diameter of the housing and a pair of terminals;

a second spacer ring made of polyvinyl chloride having an outer diameter slightly less than the inner diameter of the housing;

a cup-shaped base plate made of polyvinyl chloride having an axial hole in its bottom;

a gromet mounted within the hole in the base plate; and an electric power line passing through the gromet and connected to the terminals of the low voltage lamp, the outer edge of the lamp lying between the annular flange and the second spacer ring and the upper edge of the base plate resting against the lower edge of the second spacer ring.

* * * * *